US006511554B1

(12) United States Patent
Kawano et al.

(10) Patent No.: US 6,511,554 B1
(45) Date of Patent: Jan. 28, 2003

(54) STAINLESS SPHEROIDAL CARBIDE CAST IRON MATERIAL

(76) Inventors: Yutaka Kawano, 47-20 Kowata-akatsuka, Uji City, Kyoto (JP); Shigenori Nishiuchi, 5-6-1005 Hanazono-cho, Kuzuha, Hirakata City, Osaka (JP); Satoru Yamamoto, 11-6 Hayama-cho, Ichijoji, Sakyo-ku, Kyoto City, Kyoto (JP); Seisuke Sugahara, 2-5-28 Mikuriya-minami, Higashi-osaka City, Osaka (JP); Toshiyuki Kikuchi, 3-9-8-403 Honan-cho, Higashi, Toyonaka-city, Osaka (JP)

( * ) Notice: Subject to any disclaimer, the term of this patent is extended or adjusted under 35 U.S.C. 154(b) by 18 days.

(21) Appl. No.: 09/899,739

(22) Filed: Jul. 5, 2001

(51) Int. Cl.[7] ..... C22C 37/04; C22C 37/08

(52) U.S. Cl. ..... 148/324; 148/325; 148/327; 420/12; 420/15; 420/16; 420/17; 420/54; 420/69; 420/70; 420/100; 420/101; 420/102

(58) Field of Search ..... 148/324, 325, 148/327; 420/12, 15, 16, 17, 54, 69, 70, 100, 101, 102

(56) References Cited

U.S. PATENT DOCUMENTS 2,709,132 A * 5/1955 Giles ..... 420/12
5,225,007 A * 7/1993 Hattori et al. ..... 148/324
5,795,540 A * 8/1998 Dwars et al. ..... 420/12
6,406,563 B2 * 6/2002 Kawano et al. ..... 148/324

* cited by examiner

*Primary Examiner*—Deborah Yee
(74) *Attorney, Agent, or Firm*—Curtis L. Harrington

(57) ABSTRACT

The present invention relates to stainless spheroidal carbide cast iron material is such: comprises iron (Fe) as its main component, C 0.6~4.0% and V 4~15% as its necessary components, P 0.01~0.15%, S 0.01~0.05% Al 0.05~1.0%, and Mg 0.01~0.2% as gas (hydrogen) bubble assistants, and Si 0.2~4.5%, Cr 13~30%, Mn 0.2~3.0%, and Ni and/or Co 4~15% as anticorrosion matrix formers, and according to the case of necessary, alloy elements 0.1~1.5% of one or more kinds of Ca, Ba, Sr and rare-earth metal as a gas (hydrogen) bubble stabilizer in weight %; produced by the process that minute spheroidal space of gas (hydrogen) bubble is dispersed substantially equally into molten metal positively by high temperature melting at 1673~1973 K which is the bubbling reaction temperature, and spheroidal vanadium carbide of a covalent bond is crystallized inside of the spheroidal space, wherein just spheroidal vanadium carbide is crystallized at far colder melting temperature than former by means of compounding with the specific element as bubble assistants, and which has special characteristics such as corrosion-resistance, heat-resistance, abrasion-resistance, toughness and processing ability.

6 Claims, 15 Drawing Sheets

(a)

(1) (2) (3) (4) (5)

(b)

(1) (2) (3) (4)

50 μm

50 μm

STAINLESS SPHEROIDAL CARBIDE CAST IRON MATERIAL

TECHNICAL FIELD OF THE INVENTION

The present invention relates to stainless spheroidal carbide cast iron material, and its object is to provide stainless spheroidal carbide cast iron material wherein just spheroidal vanadium carbide is crystallized at far colder melting temperature than former, and which has special characteristics such as corrosion-resistance, heat-resistance, abrasion-resistance, toughness and processing ability.

PRIOR ARTS

With the development of industrial technology, strength, heat-resistance, abrasion-resistance, corrosion-resistance, and processing ability of materials are required to be higher than prior ones in surroundings where the apparatuses are used severely. For example, in an area of injection molding of engineering plastic, reinforcements like FRP and all kinds of additives are added into the ceramic and resin in order to raise strength, fire-resistance and abrasion-resistance of resin moldings. As a result, with the ceramic being fragile, the resin molding system is easy to be abraded because of the reinforcement within the cylindrical resin, and it further becomes easy to corrode with a corrosive gas generated from the additives. Also, since shapes of parts manufactured in all kinds of industries such as car industry are complex, abrasion of manufacturing apparatuses has become more severe than ever.

First, a usage of white cast iron which is strong cast iron can be considered in order to obtain outstanding abrasion-resistance. However, said white cast iron consisting no graphite within its organization has a defect that it is very fragile, being formed with pearlite and cementite. Therefore, it is not easy to obtain outstanding abrasion-resistance in the usage of the white cast iron. That's why a usage of spheroidal graphite cast iron with toughness, conquering the defect of white cast iron, is on trial.

Spheroidal graphite cast iron wherein a organization of flake graphite crystallized in its organization is spheroidal in shape has outstanding toughness because the organization of crystallized substance in the organizations of metallic materials gives a great influence on toughness. That is to say that generally, the organization of a crystallized substance bonds covalently or couples electro—statically, becoming a facet and platen in shape always when it has a strong anti-metal characteristic. In this circumstance, toughness is weak. Contrarily, when a characteristic of metal is strong, the organization of a crystallized substance bonds metallically, becoming a nonfacet granular or spheroidal dendrite. In these circumstances, toughness is strong due to a dispersion of force even when being given an impact from an outside. In a case of the spheroidal graphite cast iron, it has outstanding toughness because the organization of the flake graphite crystallized within the organization of cast iron is made to be spheroidal in shape with more than 0.04% of magnesium (Mg) being composed. However, it is difficult to hold both strong toughness and abrasion-resistance.

On the other hand, the present inventors have already disclosed on Japanese patent publication No. 11-124651 that alloy cast iron with outstanding abrasion-resistance and impact-resistance can be obtained by crystallizing spheroidal or granular VC system carbide and Fe—Cr system carbide within the organization of cast iron.

However, the alloy cast iron disclosed in the Japanese patent publication No. 11-124651 is outstanding in abrasion-resistance and impact-resistance, but it also has a defect that it is a little inferior in corrosion-resistance and heat-resistance.

Also, the present inventors have disclosed on the CIP application of U.S. patent application Ser. No. 09/371,158 that alloy cast iron being superior in abrasion-resistance and impact-resistance, wherein corrosion resistance and heat-resistance which are faults of the alloy cast iron described in the Japanese patent publication No. 11-124651 are improved, can be obtained by means of crystallizing the spheroidal VC carbide into the cast iron organization The alloy cast iron described in the CIP application of the U.S. patent application Ser. No. 09/371,158, however, requires high temperature melting at approximately 2,000 K or more on the manufacturing process in order to crystallizing just spheroidal VC carbide into the cast iron organization. Therefore, problems such as making lifetime of fireproof furnace ephemeral occur. In addition, since excessive energy is required to maintain the high temperature, it causes soaring of the manufacturing cost.

After continuing a devoted study of the alloy cast iron further, the present inventors then have come to invent that stainless spheroidal carbide cast iron material wherein just spheroidal vanadium carbide is crystallized at far colder melting temperature than former by means of compounding with the specific elements as bubble assistants, and which has special characteristics such as corrosion-resistance, heat-resistance, abrasion-resistance, toughness and processing ability, can be provided

DETAILED DESCRIPTION OF THE INVENTION

Hereinafter, it is described on the stainless spheroidal carbide cast iron material relating to the present invention. On the stainless spheroidal carbide cast iron material relates to the present invention, the stability and instability of system are decided by using "quantum fluctuation" arrived by the method of molecular orbital on quantum mechanics as fundamental concept. Based on the above, alloy composition and reaction temperature are decided; in addition, by coexisting bubble resource component and by means of action of bubble assistants at melting temperature of 1673~1973 K which is the bubbling reaction temperature, minute spheroidal space of gas (hydrogen) bubbles is dispersed into molten metal positively and after spheroidal vanadium carbide of a covalent bond is crystallized preferentially, spheroidal vanadium carbide is substantially equally dispersed inside of the spheroidal space by the method of coagulation. Consequently, the stainless spheroidal carbide cast iron material having the metallic composition, which is superior in processing ability and durability, is obtained. The stainless spheroidal carbide cast iron material relating to the present invention comprises: iron (Fe) as its main component; C and V as its necessary components; P, S Al and Mg as bubble assistants; Ca, Ba, Sr and rare-earth metal as bubble stabilizers; and Cr, Ni, Si, Mn as anticorrosion matrix formers, wherein spheroidal vanadium carbide is dispersed substantially equally.

Figure 1:
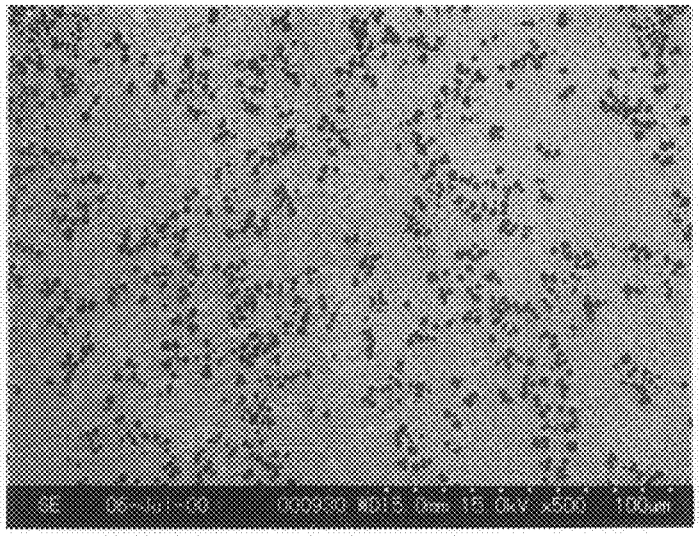
FIG. 1 is a micrograph of 500 times showing one example of geometrical spheroid in the present invention.
Figure 2:
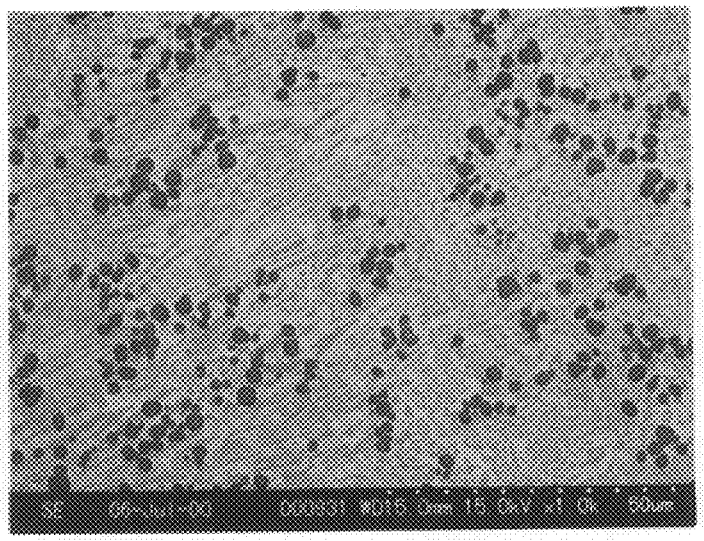
FIG. 2 is a micrograph of 1,000 times showing one example of geometrical spheroid in the present invention.
Figure 3:
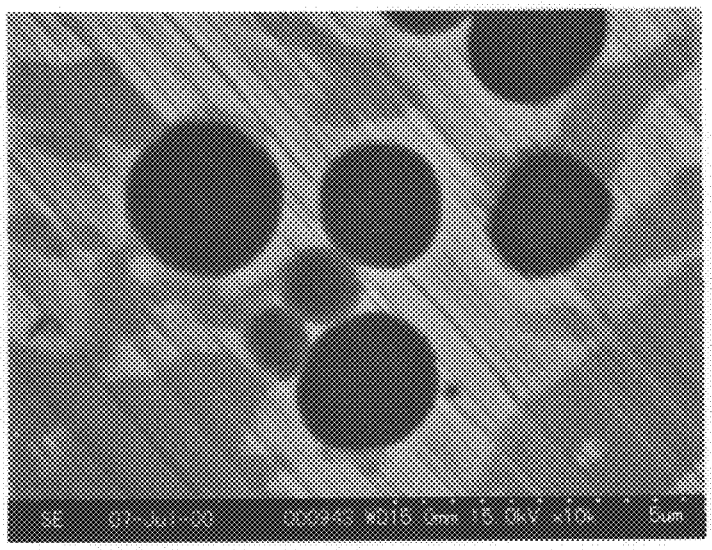
FIG. 3 is a micrograph of 10,000 times showing one example of geometrical spheroid in the present invention.
Figure 4:
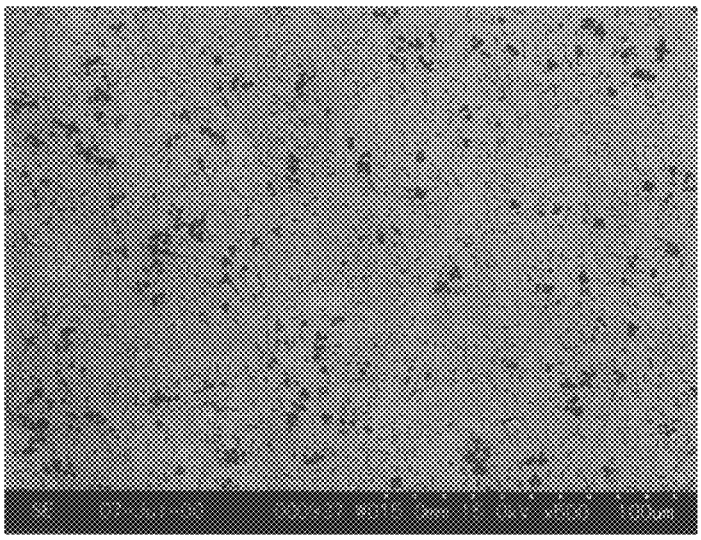
FIG. 4 is a micrograph of 500 times showing one example of granularity or lump in metal his tology.
Figure 5:
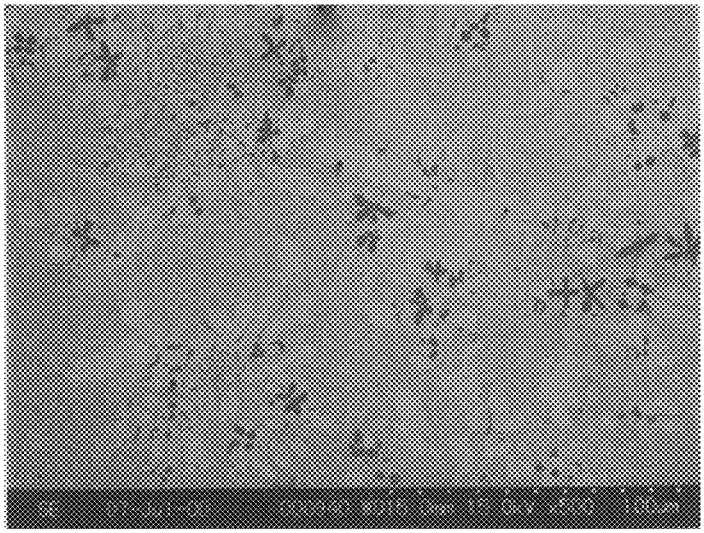
FIG. 5 is a micrograph of 1,000 times showing one example of granularity or lump in metal histology.
Figure 6:
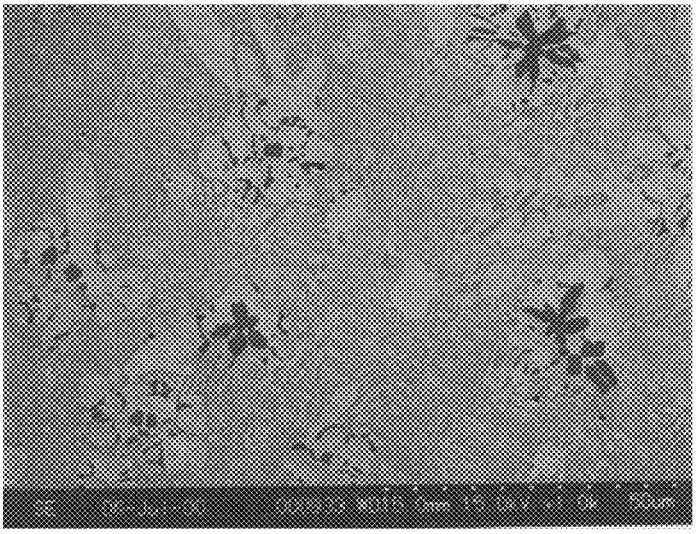
FIG. 6 is a micrograph of 10,000 times showing one example of granularity or lump in metal histology.

Hereinafter, unit of content is in weight % except with special mention. And "spheroidal" in this specification means that the shape is "spheroidal" in the notion of geometry, but is distinguished from "granular" and "lump" in metal histology. The present inventors provide stainless spheroidal carbide cast iron material wherein "spheroidal" carbide is equally dispersed, but not "granular" and "lump" carbide. In FIGS. 1~3, one example of "spheroidal" in the notion of geometry is shown, respectively. And in FIGS. 4~6, one example of "granular" or "lump" in metal histology is shown, respectively.

Alloy composition and melting method are important to form spheroidal carbide. This reason is because that when cast iron is melted as usual method, flat plate of $M_7C_3$ type carbide is formed; but spheroidal carbide is not formed. To inhibit forming of flat plate of $M_7C_3$ type carbide and to form spheroidal carbide, high temperature melt may be carried out. At low temperature flat plate of $M_7C_3$ type carbide is formed. On the other hand, at high temperature, new spheroidal carbide is formed and forming of flat plate of $M_7C_3$ type carbide is inhibited. New spheroidal carbide which is formed by the high temperature melt is vanadium carbide (hereinafter called VC carbide).

The reason of which spheroidal vanadium carbide is formed by the high temperature melt can be explained by quantum mechanically evaluating the stability of alloy system. In addition, the stability of alloy system can be explained by calculating "cohesive energy" and "energy fluctuation".

"Cohesive energy" can be given by subtracting from total energy of a system to sum of energy of isolated atoms where the energy of an isolated atom itself is given by the sum of the ionization energy of each electron.

"Energy fluctuation" (ΔE) is obtained, as shown in following equation, as the standard deviation of orbital energy (En) of all vacant orbit not occupied molecular wherein the highest occupied molecular orbital (HOMO) energy on ground state is as the standard. (Note: the possibility of which electron is excited is followed by Gibbs distribution.)

$$E^2=\langle(En-\langle En\rangle)^2\rangle$$

$$\langle En\rangle = \sum_n En\ \exp(-En/kT) \Big/ \sum_n \exp(-En/kT)$$

(Where ΔE is Energy fluctuation, En is orbital energy, and <En> is average of orbital energy.)

It is understood that "cohesive energy" expresses the static stability of system, whereas "energy fluctuation" (ΔE) defined as above expresses tendency of which electron is excited; in other words, reactivity (activity).

Figure 7:
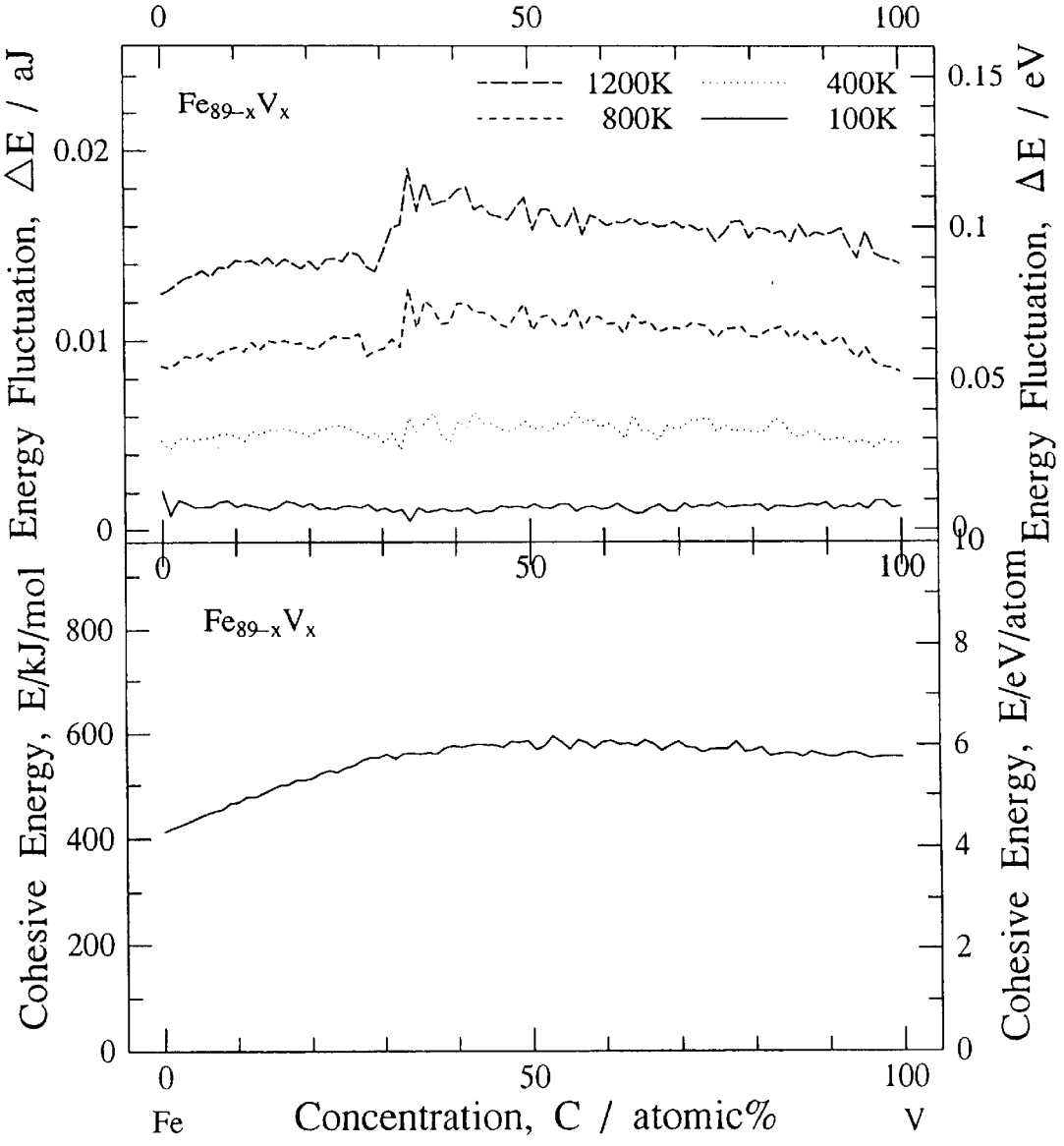
FIG. 7 is a graph showing the calculated result of energy fluctuation and cohesive energy when Fe atom is randomly substituted to V.
Figure 8:
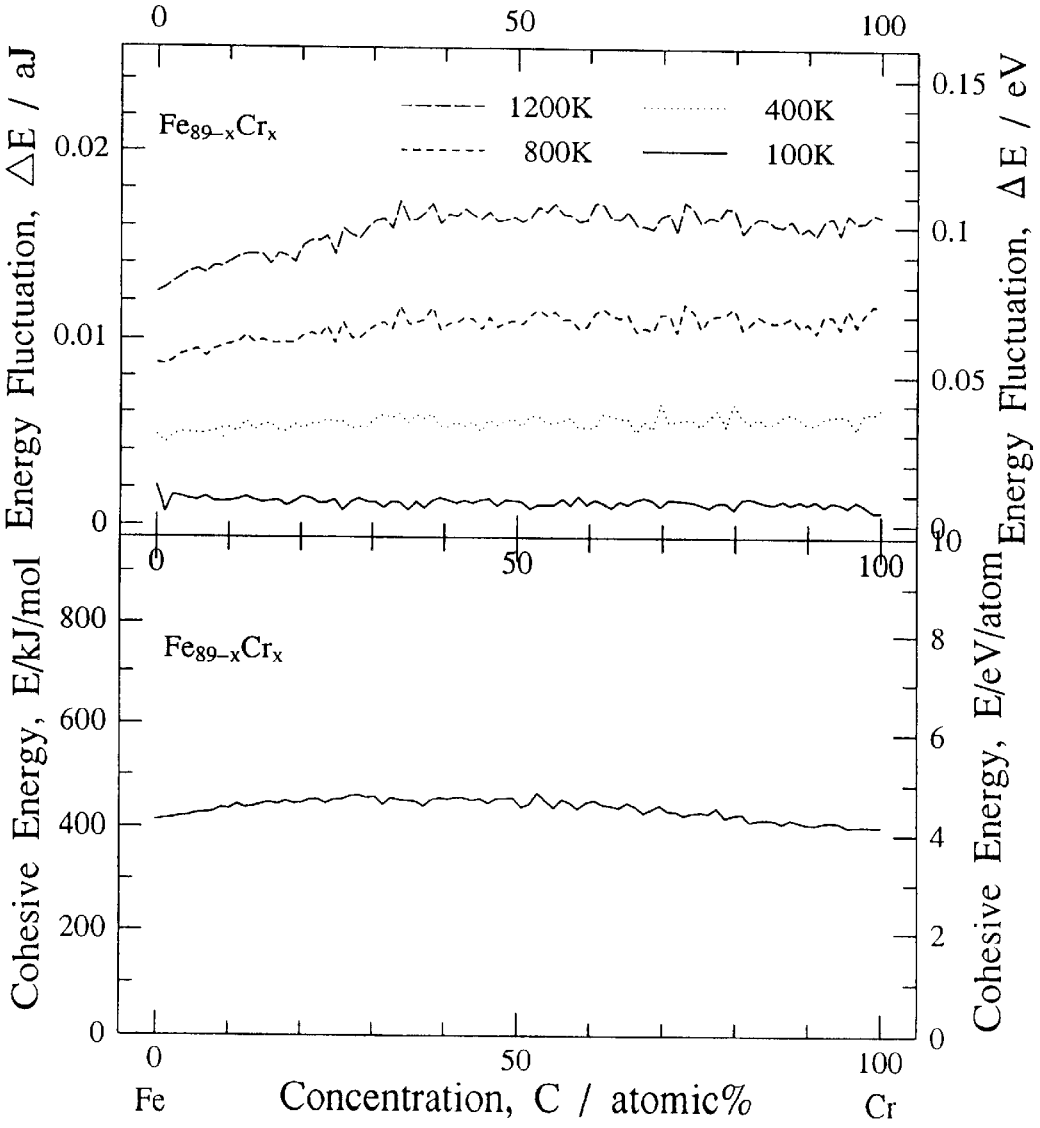
FIG. 8 is a graph showing the calculated result of energy fluctuation and cohesive energy when Fe atom is randomly substituted to Cr.

To calculate these concretely, the Schrbdinger wave equation HΨ=EΨ is numerically calculated by computer with using the extended Hückel method. In the cluster of 89 pieces of Fe atoms, calculated results of cohesive energy and energy fluctuation when Fe atoms are randomly substituted by V or Cr are shown in FIG. 7 and FIG. 8.

As the result, it finds that the changing of "cohesive energy" slowly when Fe atoms are substituted by V or Cr at random. Also, it finds that the increasing "energy fluctuation" as the temperature becomes higher. In addition, it finds that when V is added to Fe, energy fluctuation rapidly becomes bigger at high temperature in comparison with when Cr is added to Fe. This means, in Fe—V binary system, it is rapidly unstabilized at high temperature and the reactivity increases. In other words, when the temperature becomes high, the unstabilized Fe—V binary system rapidly stabilizes with reacting a formation of VC carbide. On the other hand, since $M_7C_3$ type carbide exists just at low temperature but can not exists at high temperature, it is possible that forming just spheroidal VC carbide while the formation of ordinary $M_7C_3$ type carbide is inhibited with utilizing the rapid formation reaction of VC carbide at high temperature. That is, in order to form the spherical VC carbide, C and V are indispensable, and its desired addition is 1:1 in the ratio of atomic number, and 1:4 in the ratio of weight.

Next, spheroidizing of VC carbide formed by melting at high temperature depends on gas (hydrogen) bubbles, as it is understood from the graphite spheroidizing theory: of spheroidal graphite cast iron. That is, it is required that minute gas (hydrogen) bubbles are made to generate inside of melted cast iron and it is made to disperse. V, which has a property being easy to absorb hydrogen, is utilized for this. V is a favorable element for hydrogen occlusion as clear from the study of hydrogen occlusion alloy. And in order to disperse hydrogen bubbles released form V minutely, low boiling point elements, such as the elements belonging to II a group of periodic law of elements, for example, Mg, Ca, Ba and Sr are effective. And rare-earth metal can be an assistant of releasing hydrogen bubbles since solid solution limit of hydrogen is high. By adding P, S and Al raising dispersion of minute gas (hydrogen) bubbles with small amount, such effect can be stabilized. By Adding these elements into molten metal at 1673~1973 K, low boiling point elements vaporize and hydrogen bubble assistant releases further hydrogen bubble. And Al activates the dispersion of minute hydrogen bubbles so that it is possible to form entire spheroidal carbide. In addition, in order to ensure the ability of casting for cast iron, it is required that the appropriate amount of C and V are added, and in order to improve its corrosion-resistance, toughness and heat-resistance, it is required that the appropriate amount of Ni, Si, Cr, Mn and so on are added.

As the above, it is impossible to form the spheroidal carbide by just melting alloy material as an ordinary method. In order to form the spheroidal carbide, it is required that minute spheroidal space of gas (hydrogen) bubbles are made to disperse into molten metal positively and spheroidal carbide of a covalent bond is made to form inside of the spheroidal space.

Figure 9:
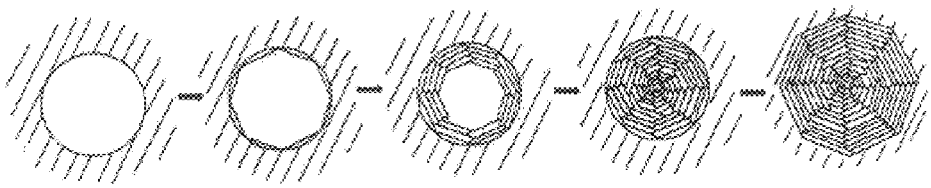
FIG. 9 is a model showing the generation process of the spheroidal carbide
Figure 9:
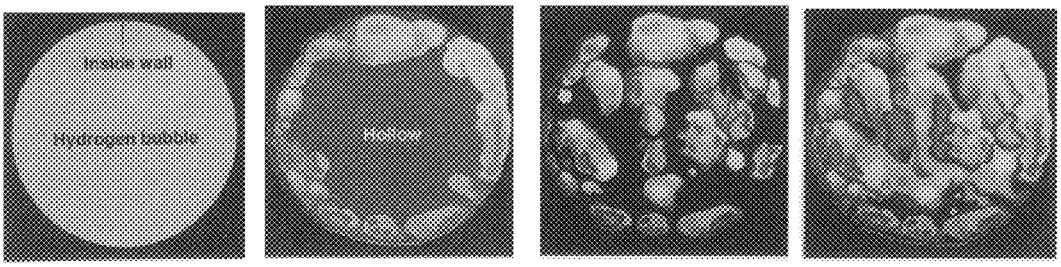
Figure 10:
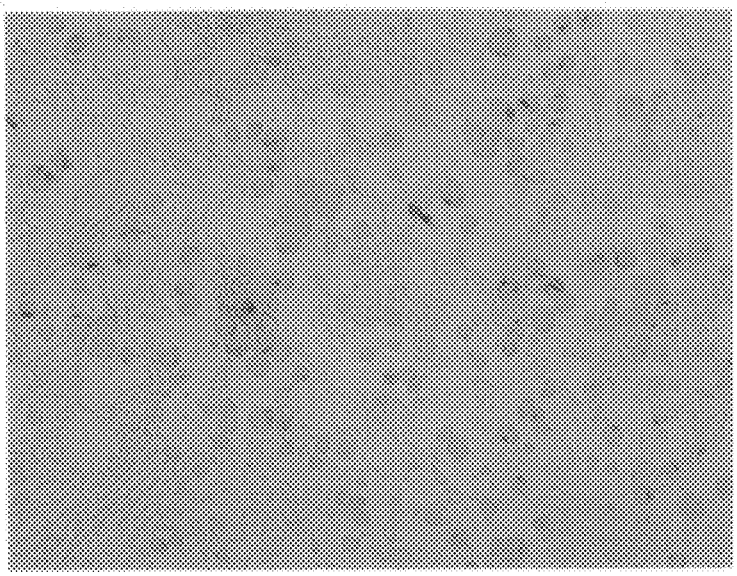
FIG. 10 is a micrograph of the metallic organization of Example 1, wherein 1.95 cm is actual 50 $\mu$m.
Figure 11:
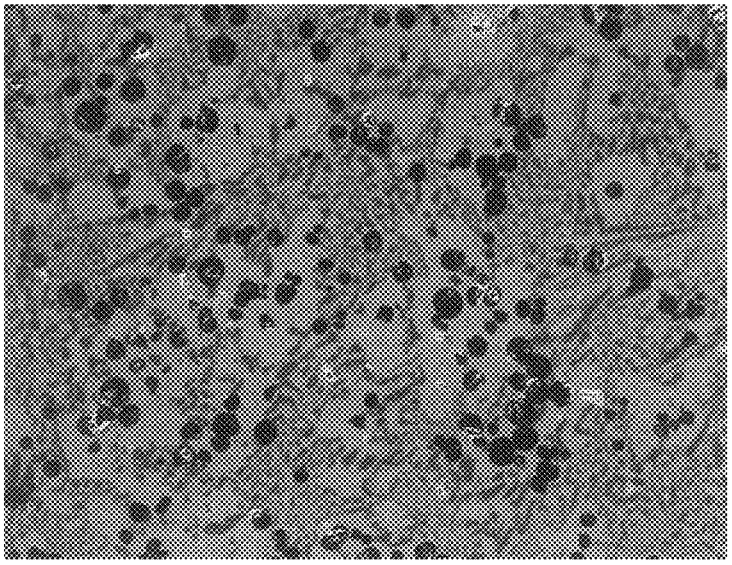
FIG. 11 is a micrograph (a reflected electron image) of the metallic organization of Example 1, wherein 1.95 cm is actual 50 $\mu$m.
Figure 12:
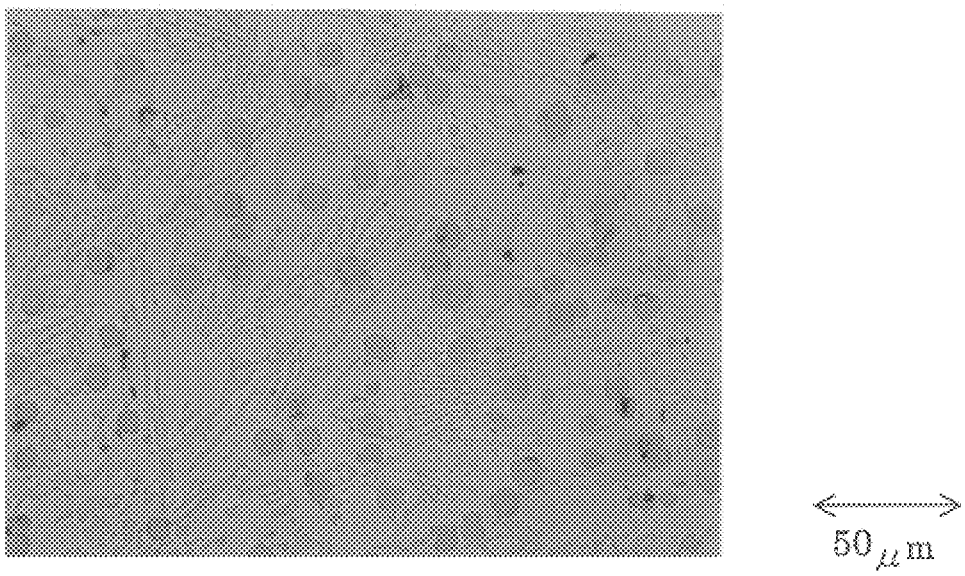
FIG. 12 is a micrograph of the metallic organization of Example 2, wherein 1.95 cm is actual 50 $\mu$m.
Figure 13:
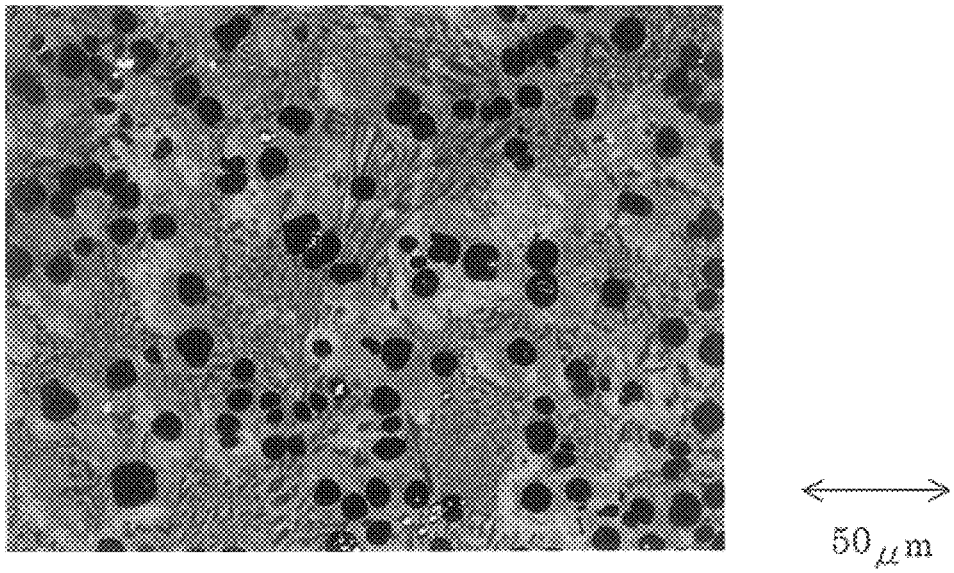
FIG. 13 is a micrograph (a reflected electron image) of the metallic organization of Example 2, wherein 1.95 cm is actual 50 $\mu$m.
Figure 14:
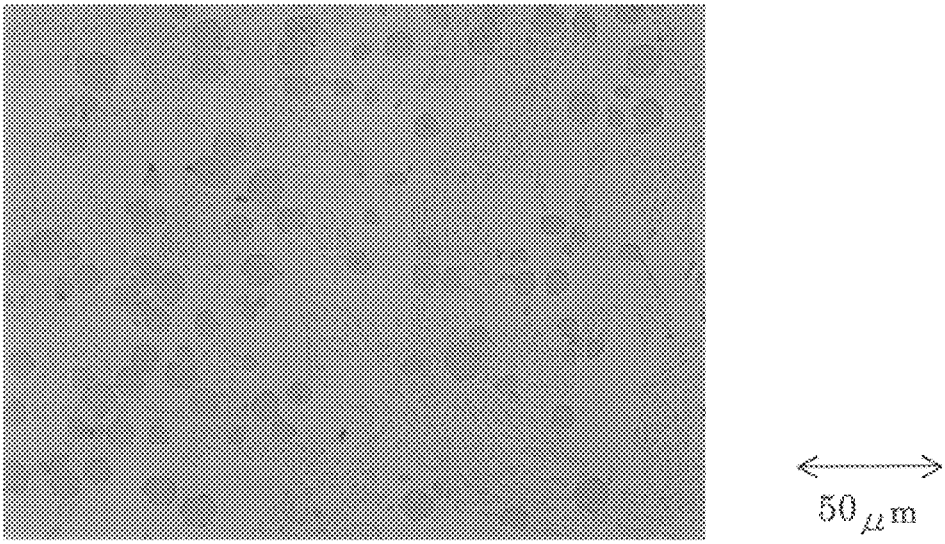
FIG. 14 is a micrograph of the metallic organization of Example 3, wherein 1.95 cm is actual 50 $\mu$m.
Figure 15:
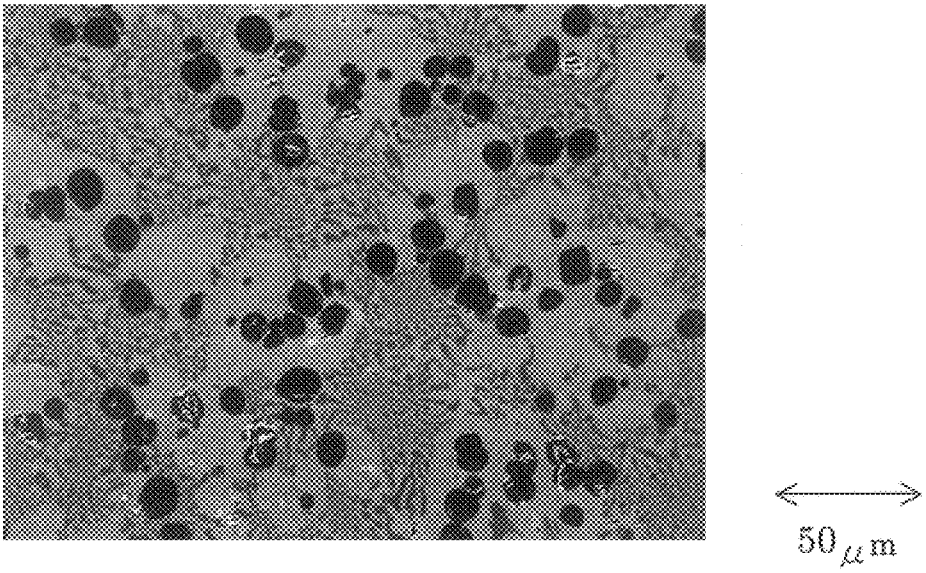
FIG. 15 is a micrograph (a reflected electron image) of the metallic organization of Example 3, wherein 1.95 cm is actual 50 $\mu$m.
Figure 16:
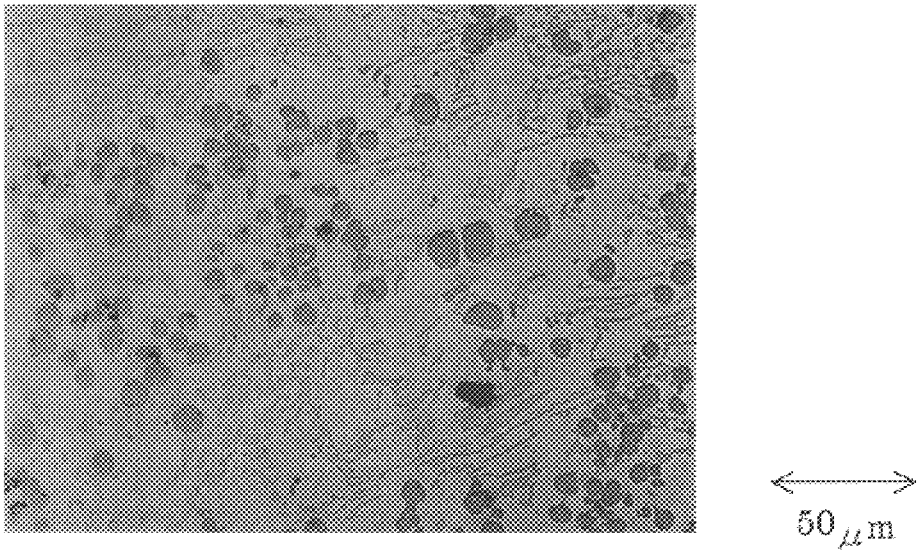
FIG. 16 is a micrograph of the metallic organization of Example 4, wherein 1.95 cm is actual 50 μm.
Figure 17:
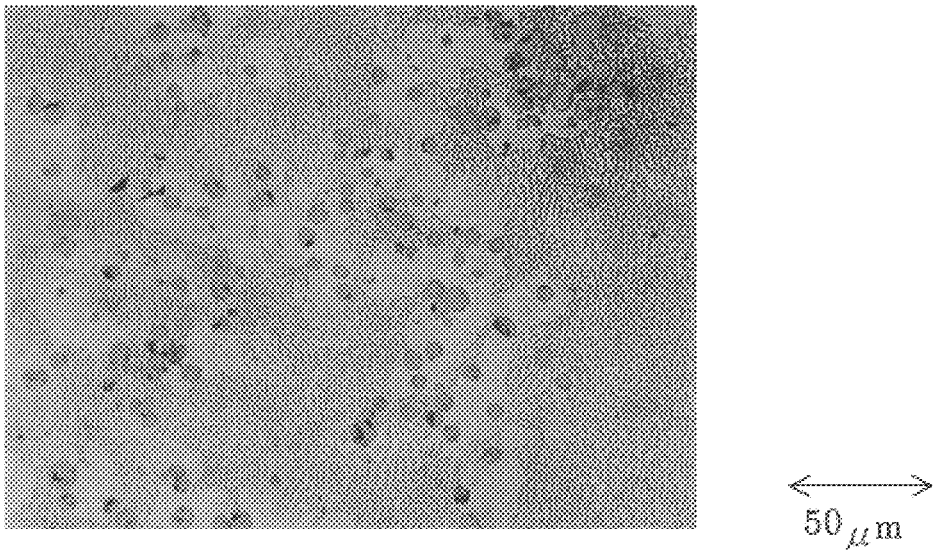
FIG. 17 is a micrograph of the metallic organization of Example 5, wherein 1.95 cm is actual 50 μm.
Figure 18:
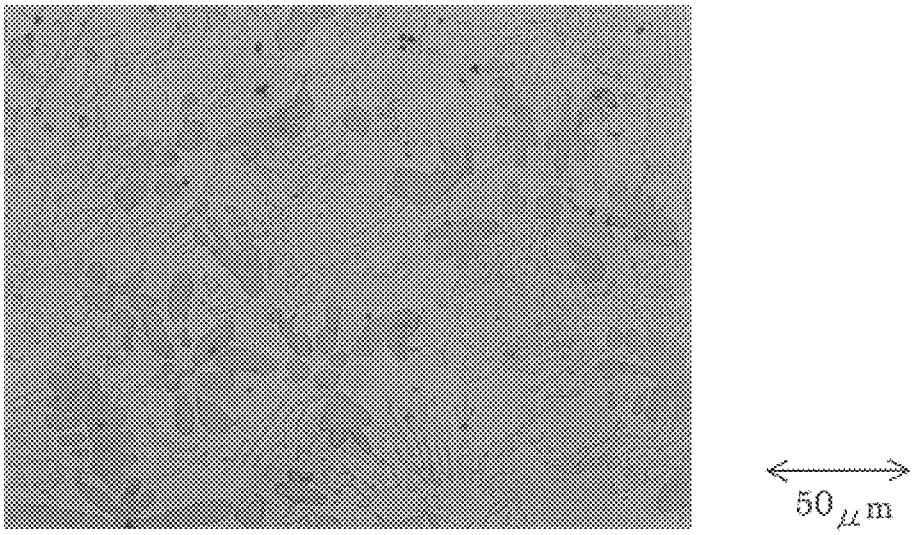
FIG. 18 is a micrograph of the metallic organization of Comparative Example 1, wherein 1.95 cm is actual 50 μm.
Figure 19:
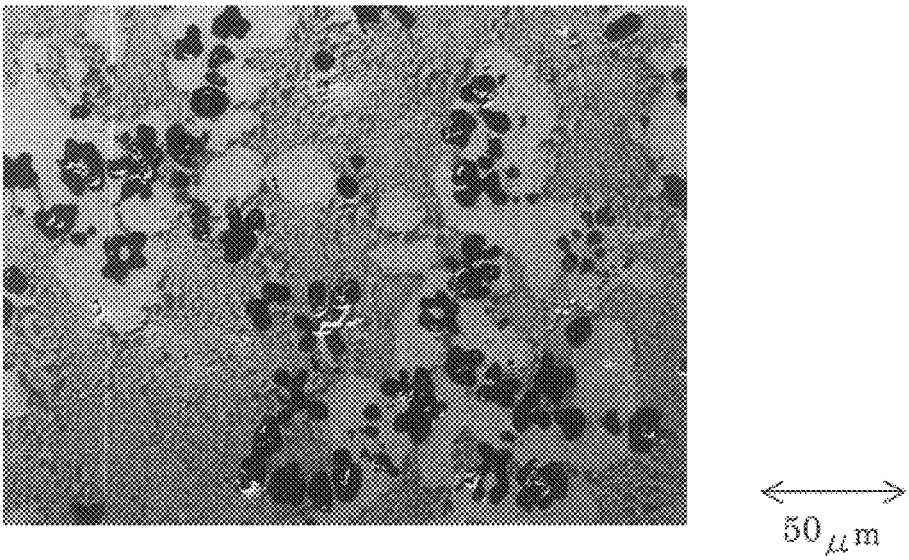
FIG. 19 is a micrograph (a reflected electron image) of the metallic organization of Comparative Example 1, wherein 1.95 cm is actual 50 μm.
Figure 20:
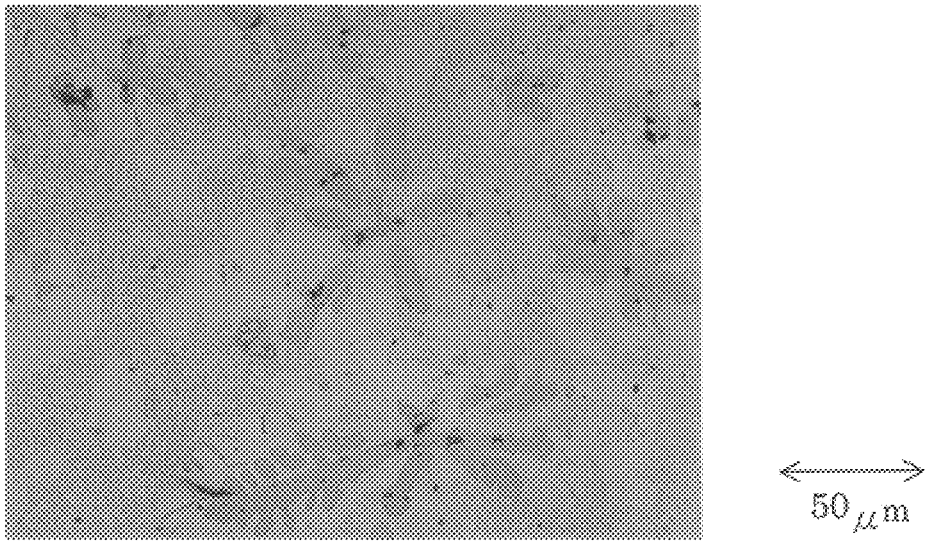
FIG. 20 is a micrograph of the metallic organization of Comparative Example 2, wherein 1.95 cm is actual 50 μm.
Figure 21:
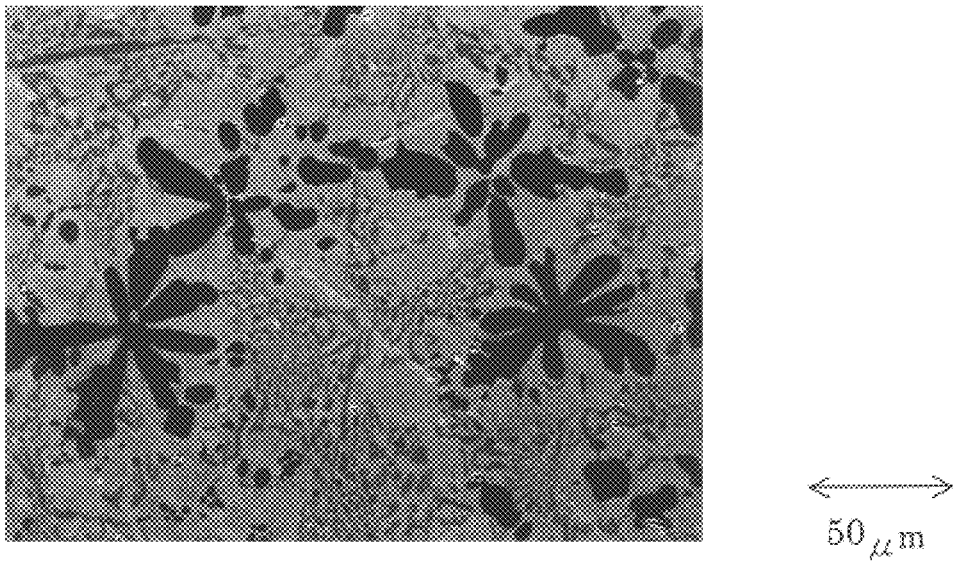
FIG. 21 is a micrograph (a reflected electron image) of the metallic organization of Comparative Example 2, wherein 1.95 cm is actual 50 μm.
Figure 22:
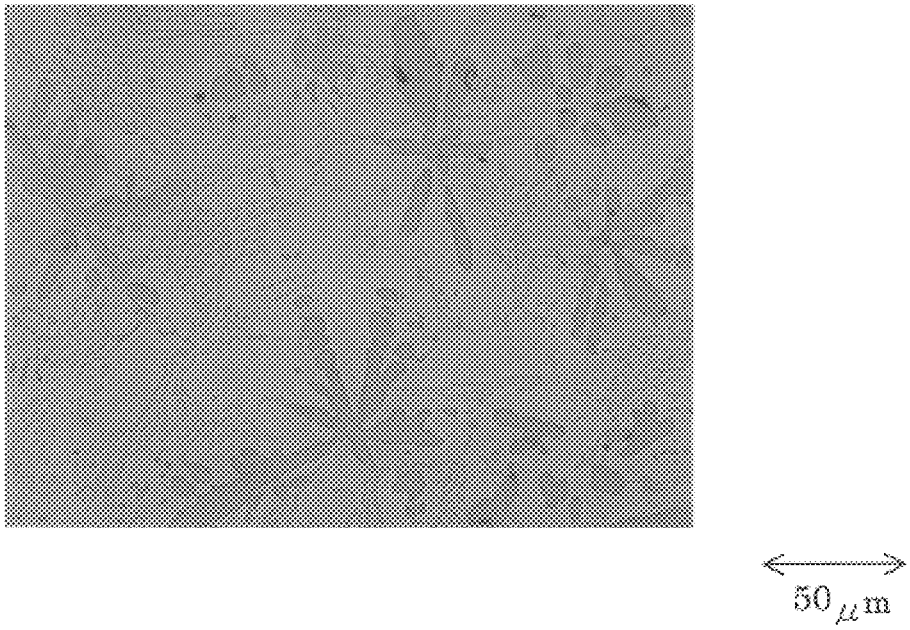
FIG. 22 is a micrograph of the metallic organization of Comparative Example 3, wherein 1.95 cm is actual 50 μm.
Figure 23:
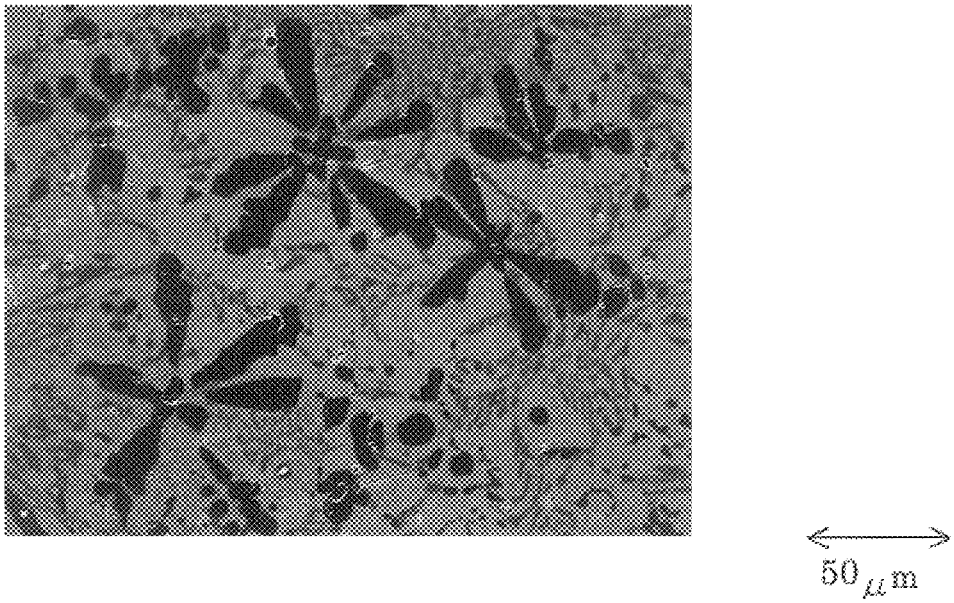
FIG. 23 is a micrograph (a reflected electron image) of the metallic organization of Comparative Example 3, wherein 1.95 cm is actual 50 μm.
Figure 24:
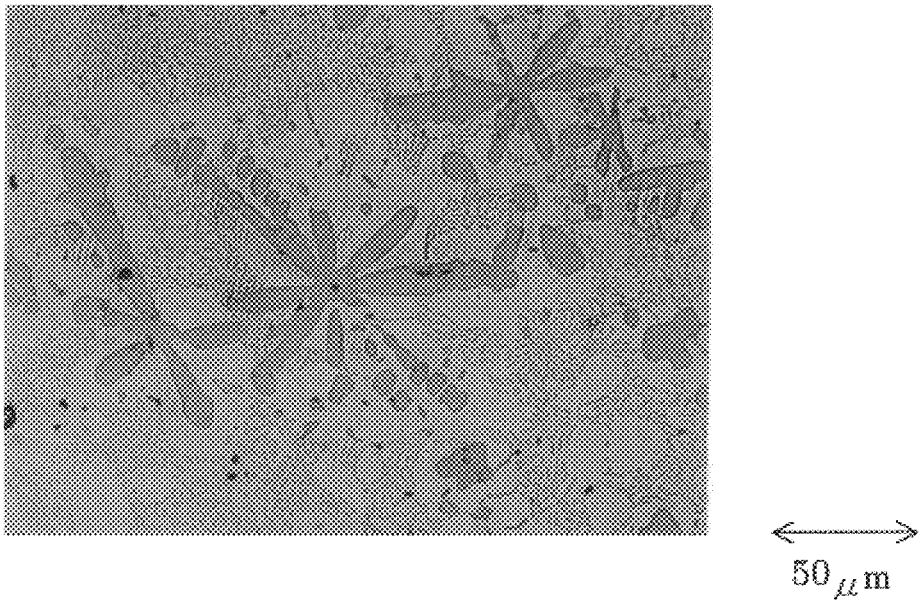
FIG. 24 is a micrograph of the metallic organization of Comparative Example 4, wherein 1.95 cm is actual 50 μm.
Figure 25:
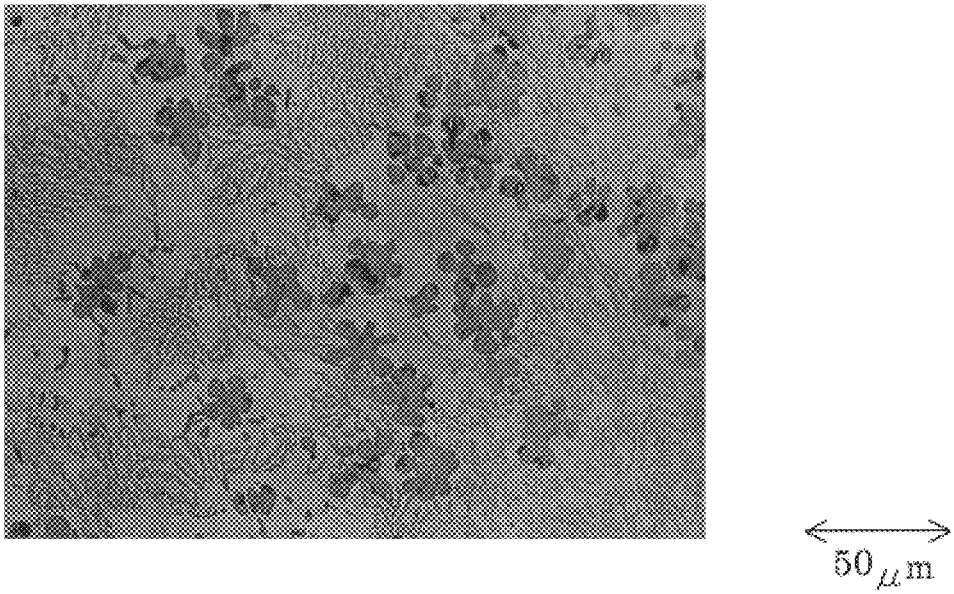
FIG. 25 is a micrograph of the metallic organization of Comparative Example 5, wherein 1.95 cm is actual 50 μm.
Figure 26:
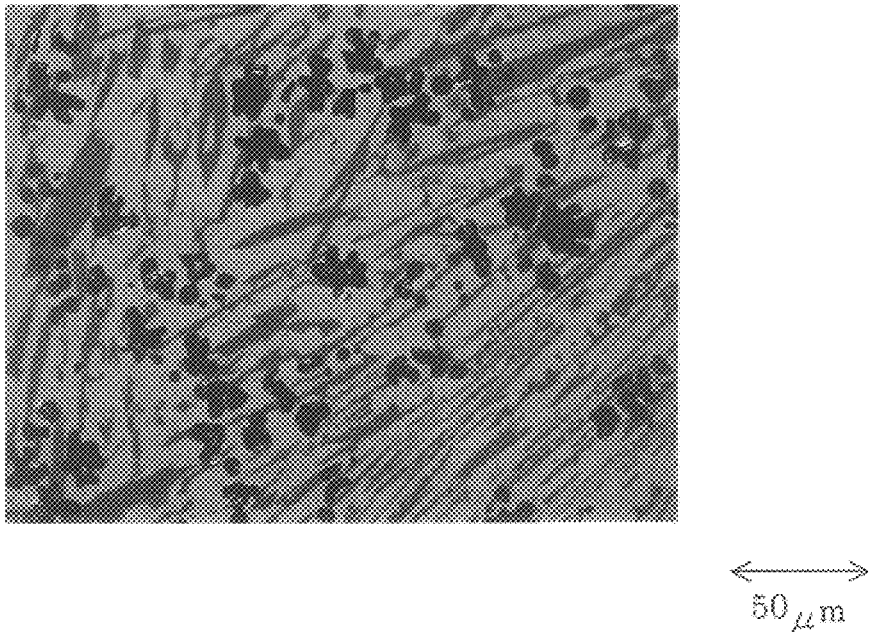
FIG. 26 is a micrograph (a reflected electron image) of the metallic organization of Comparative Example 5, wherein 1.95 cm is actual 50 μm.

A model of forming process of spheroidal carbide is shown in (a) and (b) of FIG. 9. First, the minute VC covalent bonded crystal grows along the bubble boundary (2) in minute spheroidal space (1) which is formed in the metallic organization. When the grown-up tips collide each other, it becomes granularity and grows more inside of the bubble (3). By repeating this, the spheroidal VC carbide whereof the outward shape is a spheroidal shape and which hag the inner structure as that a reticular surface is piled radially generates when the spheroidal bubble is buried to the minute VC covalent bonded crystal (4, 5).

The stainless spheroidal carbide cast iron material related to the present invention has characteristics of corrosion-resistance, abrasion-resistance, heat-resistance, toughness, casting ability, processing ability, welding ability, and so on while all of these characteristics very relate to that carbide is spheroidal. That is to say, the corrosion of material is advanced at phase boundary; however, on this case, the phase boundary is closed spheroidally so that the advance of corrosion is inhibited. The abrasion-resistance is guaranteed by the presence of hard phase; however, crack of the material is advanced from the phase boundary. Thus, advance of the crack is also inhibited by what phase is spheroidal. In addition, if the shape is spheroidal, occurrence of stress-concentration is also eased, and characteristics of heat-resistance and toughness are added. Since it is spheroidal, processing ability is improved in comparison with flat plate carbide and accuracy of processing is raised.

As described above, in order to obtain the spheroidal carbide, the melting method is important and it is required to carry out at very high temperature than the one in ordinary melting of cast iron. In other words, it requires to be melted at the bubbling reaction temperature that generates minute gas (hydrogen) bubbles inside of the melted cast iron. Concretely, 1673~1973 K, preferably 1773~1950 K, more preferably 1873~1950 K. When the melting temperature is less than 1673 K, minute gas (hydrogen) bubbles are not dispersed so spheroidal VC carbide is not formed, the $M_7C_3$ carbide is crystallized in the matrix, and fluidity of treated molten metal worsens so that it can not be cast. On the other side, when exceeding 1973 K, there is no problem to make spheroidal in shape, but yield of bubble assistant is worsened so it is not preferable. Moreover, the component shown below is contained in the stainless spheroidal carbide cast iron material related to the present invention.

First, C and V is composed to crystallized spheroidal VC carbide.

The content of Carbon (C) should be 0.6~4.0%, preferably 1.5~3.5%, more preferably 2.3~3.3%. When less than 0.6% of C composed, hardness and mechanical property of the alloy cast iron does not change much. However, when more than 0.6% of C composed, hardness and mechanical property of the alloy cast iron improve, but composing of more than 4.0% of C not only makes C change to platen carbide of Fe—Cr system (i.e. cementite) but also lowers its toughness, corrosion-resistance and heat-resistance.

The content of Vanadium (V) should be 4.0~15%, preferably 5~13%, more preferably 8~12%. When less than 4.0% of V composed, spheroidal carbide of V—C system cannot be crystallized completely because of dispersion of the very hard carbide, and no better effect can be expected with composing of more than 15% of V that would easily segregate. Neither of the above cases is desirable. It should that the content of V is as 3~6 times in weight, preferably 3.5~5.5 times in weight more preferably about 4 times in weight of content of C, since the ratio of atomic number is about 1:1 (weight ratio 4:1) in spheroidal VC carbide.

P, S, Mg and Al are contained as bubble assistants.

Phosphorus (P), Sulfur (S) and Magnesium (Mg) are low boiling point elements, evaporate in the high temperature melting cast iron, and generate minute gas (hydrogen) bubbles. Al is contained to raise dispersion the bubble.

The content of Phosphorus (P) should be 0.01~0.15%, preferably 0.04~0.13%, more preferably 0.08~0.12%. This reason is: if it is less than 0.01%, the effect to disperse bubble is not expected; and the other hand, if exceeding 0.15%, segregation and brittleness may happen; therefore, neither cases are preferable.

The content of Sulfur (S); should be 0.01~0.05%, preferably 0.015~0.03%. This reason is: if it is less than 0.01%, the effect to disperse bubble is not expected; and if it is more than 0.05%, MnS (Manganese Sulfide) becomes to be easily crystallized and corrosion-resistance decreases; therefore, neither cases are preferable.

Magnesium (Mg) can supply minute bubbles steady because the boiling point (1373 K) is relatively low, and has high spheroidal-ability of carbide because it has deoxidation action. Pure magnesium, Mg alloy, chloride of Mg, fluoride of Mg can be used as Mg; and Mg—Ni, Mg—Fe, Mg—Si—Fe, Mg—Cu, Mg—Al in the lump or briquette and so on can be exemplified as Mg alloy.

The content of Mg should be 0.01~0.2%, preferably 0.01~0.1%, more preferably 0.01~0.08%.

The effect wherein minute hydrogen bubbles are dispersed can be obtained by combining and compounding Aluminum (Al) with the metallic element belonging to II a group of periodic law table of elements, for example, magnesium (Mg) and calcium (Ca), or rare-earth metal. The content of Aluminum (Al) should be 0.05~1.0%, preferably 0.08~0.8%, more preferably 0.1~0.5%. This reason is: if the content is less than 0.05%, since the affinity with oxygen is strong, it becomes deoxidation element and the effect by compound can not be obtained; and if the content is more than 1.0%, it makes fluidity decline and the casting ability deteriorates; therefore, neither cases are preferable.

Nickel (Ni), Silicon (Si), Chromium (Cr) and Manganese (Mn) are anticorrosion matrix formers, in other words, they are compounded for improvement of corrosion-resistance, heat-resistance, and toughness.

The content of Ni should be 4.0~15%, preferably 5.0~13%, more preferably 7~10%. This reason is: if the content is less than 4.0%, it occurs metallic organization to be martensite and it becomes to be hard and to brittle; and the other hand, if exceeding 15%, segregation is promoted and a base becomes to be weak; therefore, neither cases are preferable.

Silicone (Si) is the effective element to the heat-resistance and can make the oxidation decreasing decrease remarkably. The content of silicone should be 0.2~4.5%, preferably 0.5~4.0%, more preferably 1.0~3.0%. This reason is: if it is less than 0.2%, the effect by the Si containing can not be shown because of aggravating of the yield of V, whereas toughness decreases when exceeding 4.5%; therefore, neither cases are preferable.

The content of Chromium (Cr) should be 13~30%, preferably 13~25%, more preferably 16~20%. When less than 13% of Cr composed, stable austenite (γ) cannot be crystallized with decreasing heat-resistance and corrosion-resistance against oxidizing solution. On the other hand, with composing of more than 30% of Cr, flat plate carbide is crystallized with segregation causing a deterioration of strength. Neither of the above cases is desirable.

When mixing Manganese, (Mn), its content should be 0.2~3.0%, preferably 0.3~2.0%, more preferably 0.4~1.5%. Composing of more than 3.0% of $M_7C_3$ is not desirable for the alloy cast iron of V—C system as it easily segregates.

The above mentioned elements are the necessary components that are included with iron (Fe) which is a main component. In the present invention, 0.1~1.5%, preferably 0.5~1.5%, more preferably 0.5~0.8% of what at least one or more kinds selected from additives which are Ca, Ba, Sr and alloy elements belonging to rare-earth metal that are described below are contained.

Calcium (Ca) melts into molten metal hardly, but the Ca—Si combination wherein the combination is strong increases by adding Ca. Therefore, the melting point of Mg alloy rises and it can make the generation of the minute bubbles in molten metal progress quietly.

When Ca is compounded, its content is not particularly limited if it is in the range of the containing. quantity as above, but it should be 0.2~0.8%, preferably 0.3~0.7%, more preferably 0.4~0.6%.

The boiling points of barium (Ba) and strontium (Sr) which belong to the other of II a group of periodic law of elements are higher than the Mg's, but their melting points are low, and the effect like Al's, which minute hydrogen bubbles are dispersed can be obtained. Especially, the fading phenomenon which occurs, to the Mg can be eased.

When Ba is compounded, its content is not particularly limited if it is in the range of the containing. quantity as above, but it should be 0.01~1.0%, preferably 0.01~0.5%, more preferably 0.01~0.2%.

Also, when Sr is compounded, its content is not particularly limited if it is in the range of the containing quantity as above, but it should be 0.01~1.0%, preferably 0.01~0.5%, more preferably 0.01~0.2%.

Rare-earth metal has large hydrogen occlusion volume because its melting point is low and the solid solution limit of hydrogen is high. Because of this, there is an effect to assist hydrogen bubbles. Also, the fading phenomenon of the Mg can be eased. Incidentally, it is possible to use any rare-earth metal as rare-earth metal, but in this invention, elements which belong to the cerium group, such as cerium (Ce), lanthanum (La), neodymium (Nd), praseodymium (Pr), promethium (Pm), samarium (Sm), europium (Eu) are preferably used, and in Ce, La, Nd or rare-earth metal belonging to the cerium group, especially Misch metal which is mixture of light rare-earth elements is used more preferably.

When Rare-earth metal is compounded, its content is not particularly limited if it is in the range of the containing quantity as above, but it should be 0.1~1.0%, preferably 0.1~0.6%, more preferably 0.2~0.5%.

Incidentally, on this invention, when one or more kind of alloy elements of Ca, Ba, Sr, and rare-earth metal is/are contained, one or more kinds of alloy elements of Ca and Misch metal is/are preferably contained, and it is more preferable that mixture of one or more kind of alloy elements of Ca, Ba, Sr (preferably Ca) and one or more kinds of alloy elements (Misch metal) of rare-earth metal are contained.

Moreover, in the present: invention, at least one or more kinds selected from the group consisting of: (a) Mo; (b) Ti; (c) B; and (d) at least two or more kinds of alloy elements of Cu, W, Zr, Co, Nb, Ta and Y, can be mixed within said necessary components as one please.

Molybdenum (Mo) is effective in preventing deposition of graphite and in stabilizing the base. When mixing Mo, its content should be 0.05~15%, preferably 0.1~13%, more preferably 1.0~7.0%. Composing of both less than 0.05% of Mo wherein Mo cannot be as effective as said previously and more than 15% of Mo wherein spheroidal carbide of V—C system cannot be crystallized stably because of dispersion of the very hard carbide with deterioration of corrosion-resistance are not desirable.

Furthermore, if the improvement of heat-resistance is desired particularly, the content of Mo should be 0.05~5% because composing of more than 5% of Mo deteriorates the heat-resistance a little.

Titanium (Ti) is effective; in denitrification and in refining the organization of alloy cast iron. When mixing Ti, its content should be 0.01~5.0%, preferably 0.05~4.5%, more preferably 0.1~3.5% Composing of both less than 0.01% of Ti wherein Ti cannot refine effectively and more than 5.0% of Ti wherein making carbide of V—C system to be spheroidal in shape is deteriorated with increased deposition of Ti are not desirable.

Furthermore, if the improvement of heat-resistance is desired particularly, the content of Ti should be 0.01~1.0% because composing of more than 1.0% of Ti deteriorates the heat-resistance a little.

Boron (B) is effective for increasing hardness in a heat treatment. When including B, its content should be 0.01~2.0%, preferably 0.05~1.5%, more preferably 0.1~1.0%. Composing of both less than 0.01% of B wherein B cannot be as effective:as said previously and more than 2.0% of B causing a deterioration of strength are not desirable.

Furthermore, if the improvement of heat-resistance is desired particularly, the content of B should be 0.01~0.5% because composing of more than 0.5% of B deteriorates the heat-resistance a little.

Copper (Cu), Tungsten (W), Zirconium (Zr), Cobalt (Co) Niobium (Nb), Tantalum (Ta) and Yttrium (Y) can be included to meet purposes such as for the improvement of corrosion-resistance, abrasion-resistance and heat-resistance as one wishes. More than two kinds of these elements would be better to be included so that much more outstanding effects can be obtained even though the composing of one kind of these elements is effective. However, a random composition of these elements would not always make a covalent bond strong, so when an improvement of corrosion-resistance is desired, a.total content of more than two kinds of elements should be 0.2~5%. Further, when an improvement of heat-resistance is desired, a total content of more than one kind of elements should be 0.2~10%, as it is more effective to include larger amount of these elements.

Incidentally, to prevent metallic organization to be martensite, the combination of Cobalt (Co) which shows the same effect as Nickel (Ni) is effective. Especially, when improving abrasion-resistance, substituting the part or all of the content of Ni appropriately to Co is effective. That is, total content of Ni and Co is 4.0~15%, preferably 5.0~13%, more preferably 7~10%.

In the present invention, said composition components explained above can be included appropriately in addition to the necessary components: C, V, P, S, Al, Mg, Ni, Si, Cr, and Mn, to meet purposes as one wishes, and can be added, melted, and cast at 1673~1973 K. Particularly, it is effective to include: P, S, Mg, Ca, Ba, Sr and rare-earth metal for a stabilization of spheroidal VC carbide; Ni, Si, Cr and Mn for forming of anticorrosion matrix; Mo, Ti, B, Cu, W, Zr, Nb, Ta, Y and Co for corrosion-resistance, abrasion-resistance and making toughness.

The stainless spheroidal carbide cast iron material comprising said composition can be obtained, as the usual method, by cooling and leaving of poured molten metal in a mold. Also, it is annealed for about two hours at 823±50 K because eliminating casting stress, which occurs at cooling is desirable. The leaving organization is an austenite (γ)+VC complex and heat treatment is not effective.

And, there are no differences between the alloy cast iron and its organization which are produced as left casting when they are treated with normalizing and annealing.

EXAMPLES

Following is a detailed explanation of the stainless spheroidal carbide cast iron material disclosed in the present invention based on examples. Note that the present invention is not restricted to the following examples.

Conditions of Melting Production and Material to be Tested

First, according to the composition mentioned in Table 1, samples of Examples 1~5 and Comparative Examples 1~5 were prepared.

Said prepared samples are melted with using 50 kg of high frequency induction furnace (ramming material MgO+$Al_2O_3$). About Examples 1~5 and Comparative Examples 1~4, after fusion began, C, V, and a corrosion-resistant matrix-material were melted with increasing the temperature to 1923 K, hydrogen bubble assistants and stabilizers were added, were reacted, and then micro organization observation test pieces (30ϕ×100 L) and mechanical test pieces were gathered to the sand mold at 1873 K. After casting, heat-treatment of air-cooling was carried out after maintaining for 1 hour at 873 K.

About Comparative Example 5, after fusion began, C, V, and a corrosion-resistant matrix material were melted with increasing the temperature to 1670 K, hydrogen bubble assistant and stabilizer were added, were reacted, and then micro organization observation test pieces (30ϕ×100 L) and mechanical test pieces were gathered to the sand mold at 1623 K. After casting, heat-treatment of air-cooling was carried out after maintaining for 1 hour at 873 K.

Table 1 is described in next page . . . .

TABLE 1

| | C | V | Al | Ni | Si | Cr | Mn | P | S | Co | Mg | Ca | Ba | Sr | Misch Metal | Fe + Impurities |
|---|---|---|---|---|---|---|---|---|---|---|---|---|---|---|---|---|
| Example 1 | 3.0% | 10.0% | 0.3% | 9.0% | 1.5% | 18.0% | 0.7% | 0.08% | 0.03% | — | 0.10% | — | — | — | — | Remaining |
| Example 2 | 3.0% | 10.0% | 0.3% | 9.0% | 1.5% | 18.0% | 0.7% | 0.08% | 0.03% | — | 0.10% | 0.50% | — | — | — | Remaining |
| Example 3 | 3.0% | 10.0% | 0.3% | 9.0% | 1.5% | 18.0% | 0.7% | 0.08% | 0.03% | — | 0.10% | 0.40% | — | — | 0.30% | Remaining |
| Example 4 | 3.0% | 10.0% | 0.3% | 9.05 | 1.5% | 18.0% | 0.7% | 0.08% | 0.03% | — | 0.10% | — | 0.10% | 0.10% | — | Remaining |
| Example 5 | 3.0% | 10.0% | 0.3% | — | 1.5% | 18.0% | 0.7% | 0.08% | 0.03% | 9.0% | 0.10 | 0.40% | — | — | 0.30% | Remaining |
| Comparative Example 1 | 3.0% | 10.0% | 0.3% | 9.0% | 1.5% | 18.0% | 0.7% | 0.08% | 0.03% | — | 0.21% | — | — | — | — | Remaining |
| Comparative Example 2 | 3.0% | 10.0% | 0.3% | 9.0% | 1.5% | 18.0% | 0.7% | 0.08% | 0.03% | — | 0.21% | 0.80% | 0.10% | 0.10% | 0.60% | Remaining |
| Comparative Example 3 | 3.0% | 10.0% | — | 9.0% | 1.5% | 18.0% | 0.7% | 0.08% | 0.03% | — | 0.10% | 0.50% | — | — | — | Remaining |

TABLE 1-continued

| | C | V | Al | Ni | Si | Cr | Mn | P | S | Co | Mg | Ca | Ba | Sr | Misch Metal | Fe + Impurities |
|---|---|---|---|---|---|---|---|---|---|---|---|---|---|---|---|---|
| Comparative Example 4 | 3.0% | 10.0% | — | 9.0% | 1.5% | 18.0% | 0.7% | 0.08% | 0.035 | — | — | 0.50% | — | — | 0.40% | Remaining |
| Comparative Example 5 | 3.0% | 10.0% | 0.3% | 9.0% | 1.5% | 18.0% | 0.7% | 0.08% | 0.03% | — | 0.10% | — | — | — | — | Remaining |

(TEST 1)

Observation of Micro Organization

To observe a micro organization, a portion of 30 mm from the lower part of materials to be tested of Examples 1~5 and Comparative Examples 1~5 were cut and were observed with the metal microscope and the electronic microscope after abrasive. The metal organization and the reflected electron images of VC carbide were photographed.

The results of Examples 1~5 are shown in FIGS. 10~17, respectively; results of Comparative Examples 1~5 are shown in FIGS. 18~26, respectively.

(TESTS 2 and 3)

Tensile Strength and Elongation

The tensile strength and the elongation of alloy cast iron obtained in said Examples 1~5 and in said Comparative Examples 1~5 were tested. For test pieces, "JIS Z 2201 No. 4 test pieces for tensile test for metallic materials" were used according to "The shapes and measurements of common test sample (a) in JISG 0307 Steel Castings-General Technical Requirements". As a method of the test, said No. 4 test pieces were used in order to measure both the tensile strength and the elongation in accordance with "JIS Z 2241 standard of testing method for tensile strength of metallic materials".

The result of tensile strength and elongation are shown in Table 2.

(TEST 4)

Impact Test

The impact of alloy cast iron obtained in said Examples 1~5 and in said Comparative examples 1~5 were tested. JIS No. 3 test pieces without notches in a shape of 10×10×55 mm wherein oxide on surfaces of the test pieces was taken away with a belt type abrasion system before Charpy impact test was carried out as for a method of test: "JISZ2242 metal material impact test method". Ruptured surfaces were observed wherein surfaces with defects were excluded.

The result of the impact test is shown in Tables 2.

(TEST 5)

Measurement of Hardness

The hardness of alloy cast iron obtained in said Examples 1~5 and in said Comparative examples 1~5 were tested. "C scale ($H_RC$)" of "Rockwell hardness ($H_R$)" as an index was used in the test in accordance with "The method of Rockwell hardness test" as shown in "JISZ 2245" (i.e. In order to calculate the hardness with definite equation, differences between depths of indenter trespass at rated load before and after the test load is added onto the test piece can be measured within the following processes; firstly, a rated load is added onto a test piece, and further a test load is added, and then the test piece was brought back to with rated load again, using diamond indenters and spheroidal indenters.).

The result of the measurement of hardness is shown in Tables 2.

(TEST 6)

Abrasion Test

Figure 27:
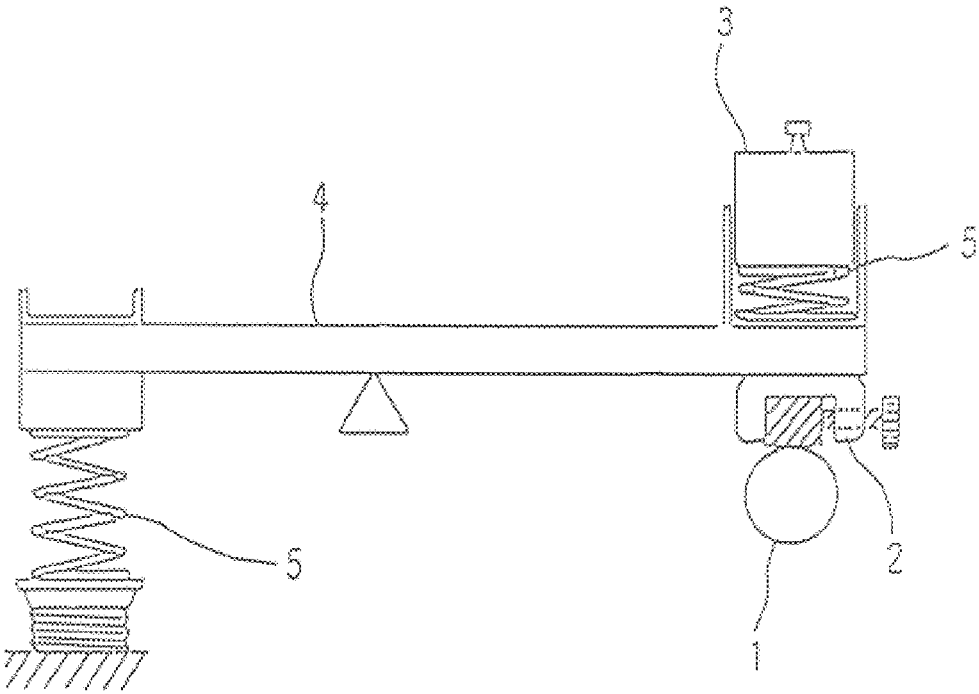
FIG. 27 is a schematic explanatory diagram of the abrasion tester used in Test 6.

Using the abrasion tester: indicated in FIG. 27, the alloy cast iron obtained in said Examples 1~5 and in said Comparative examples 1~5 were tested in the following process of abrasion test.

A stick of 10 mm height as a test piece was cut out from the common test sample of 25 mm square×50 mm height, and was fixed onto a screw holder (2), and then was cut down to 120 mm×120 mm height. Also, as for a grindstone contacting with the test piece, a grindstone shaped in ϕ 25 mm×2 mm with #80 abrasive grain with a shaft comprising a sintered materials $Al_2O_3$ on the market at about 1473 K wherein about 30% of clay binder was mixed into was used.

Each surfaces of the test sample were abraded with #80 by using a belt-type abrader and with an attention paid especially with the surfaces where the grindstone touched to be leveled.

After confirming that there was no attachment on the surfaces of test sample, its weight was scaled with a precision balance as a pre-abrasion test weight.

Secondly, the test sample was put onto a holder portion with its test surface down, and a screw stopper was tightened from the sides with the test surface adjusted to be level using a level stand which is set at the same height as the grindstone.

After adjusting the balance of tester, 0.2 kg of weight for load (3) was put right above the test sample, and free running of the test sample was suppressed by installing a spring stopping swings (5) on the other side of the balance (4) to the test sample.

In this situation, the abrasion tester was started with its rotating speed at 1700 rpm. Within 90 seconds as its rotating time, dressing for preventing blinding of the grindstone with a shaft was done with a dressing grindstone at 30 and 60 seconds after starting.

After the test was over, the test sample wherein polishing powder attached onto the test sample was swept away was scaled with a precision balance again. The difference of the test sample weight of before and after the test was set as abraded amount.

The result of the abrasion test is shown in Tables 2.

(TEST 7)

Corrosion-resistance Test

Using the alloy cast iron obtained in said Examples 1~5 and in said Comparative examples 1~5, the corrosion-resistance against $H_2SO_4$ (7N) and HCl (1N) was tested. As for a testing method, after a test sample of $10mm^3$ finished wholly (emery No. 320 finish) was degreasing washed, and its weight and surface area were measured. Each test piece was put separately into a 500 ml beaker wherein 300 ml of $H_2SO_4$ (7N) and HCl (1N) were poured into respectively. After the test piece in $H_2SO_4$ (7N) which was boiled and the test piece in HCl (1N) which was soaked in room temperature for 140 hours are washed and dried, the weight and surface area of each test piece were measured. Then, the loss in corrosion was measured in mg/cm$^2$.

In addition, corrosion-resistance test is carried out as same as above by using SUS304 said that is superior in corrosion-resistance. Furthermore, the composition of SUS304 is shown in Table 3.

The result of corrosion-resistance test is shown in Tables 2 and 3.

Table 2 is described in next page . . . .

EFFECTS OF THE PRESENT INVENTION

As explained in detail above, the stainless spheroidal carbide cast iron material in the invention, as set forth in claim 1 shows that spheroidal carbide can be crystallized at far colder melting temperature than former because the specific bubble assistants are compounded. Also it has superior abrasion-resistance, toughness and processing ability, and has the corrosion-resistance and heat-resistance which are equal to those of stainless steel because the carbide crystallized in the organization is made to be in spheroidal shape.

The stainless spheroidal carbide cast iron material in the invention as set forth in claim 2 has the outstanding abrasion-resistance and heat-resistance, and is able to improve its corrosion-resistance largely.

The stainless spheroidal carbide cast iron material in the invention as set forth in any one of claims 3 and 4 has the outstanding abrasion-resistance and heat-resistance, and is able to improve its corrosion-resistance largely.

The stainless spheroidal carbide cast iron material in the invention as set forth in any one of claims 5 and 6 has the outstanding abrasion-resistance and heat-resistance, and is able to improve its corrosion-resistance largely.

TABLE 2

| | Example 1 | Example 2 | Example 3 | Example 4 | Example 5 | Comparative Example 1 | Comparative Example 2 | Comparative Example 3 | Comparative Example 4 | Comparative Example 5 | SUS 304 |
|---|---|---|---|---|---|---|---|---|---|---|---|
| Tensile strength (Mpa) | 682 | 701 | 710 | 685 | 730 | 565 | 550 | 538 | 526 | 620 | — |
| Elongation (%) | 0.8 | 1.5 | 1.8 | 0.5 | 0.1 | 0.0 | 0.0 | 0.0 | 0.0 | 0.0 | — |
| Impact Value (J/cm$^3$) | 12.0 | 13.0 | 13.0 | 11.5 | 9.2 | 6.3 | 4.7 | 6.5 | 4.4 | 6.5 | — |
| Hardness ($H_RC$) | 39.0 | 41.0 | 40.6 | 40.2 | 61.0 | 43.0 | 44.2 | 41.8 | 42.3 | 42.5 | — |
| Abrasion Co-efficient (mg) | 1.90 | 1.78 | 1.70 | 1.98 | 1.35 | 5.16 | 5.36 | 4.85 | 4.65 | 4.60 | — |
| Anti-corrosion 7N—$H_2SO_4$ (mg/cm$^2$) | 3.96 | 3.83 | 3.80 | 3.95 | 9.38 | 6.75 | 6.36 | 5.26 | 4.26 | 7.20 | 19.92 |
| Anti-corrosion 1N—HCl (mg/cm$^2$) | 2.85 | 2.63 | 2.65 | 2.86 | 5.12 | 4.36 | 4.25 | 3.56 | 3.41 | 5.21 | 6.23 |

TABLE 3

| | C | Si | Mn | P | S | Ni | Cr | Fe + Impurities |
|---|---|---|---|---|---|---|---|---|
| SUS304 | 0.07% | 0.8% | 1.5% | 0.04% | 0.01% | 8.0% | 18.0% | Remaining |

(TEST 8)

Underwater Pump and Impeller Proving Test

An underwater pump and impeller as a drain treatment system of sludge storage tank were test proved. Actual usage of the sludge storage tank was pH 4~7 (design pH 7~9), and sand was mixed into as foreign material within the sludge. Also the concentration of the sludge was around 3%. The composition of said treatment system of sludge storage tank was analyzed with a fluorescent X-ray as, the concentration of sludge 0.5%, $FeSO_3$ 18.0%, $SO_3$ 6.1%, $Al_2O_3$ 4.2%, $SiO_2$ 8.8%, $V_2O_5$ 2.9%; and organic substance (C) 63.0%. Incidentally, the demonstration value of pH was 5.0.

Impellers with outer diameter ϕ230 using the alloy cast iron of Example 3 and former cast iron FC200 as its material was made for the proving test in which the impeller was put onto the underwater pump for sludge treatment. As a result, 0.15% weight of the impeller made out of the alloy cast iron of Example 3 was reduced after 1,003 hours of running. On the contrary, 9.00% weight of the impeller made out of the former cast iron was reduced after 844 hours of running. Therefore, the abrasion-resistance and corrosion-resistance of the impeller made out of the alloy cast iron used for the example was far better than those of the impeller made out of the former cast iron.

What is claimed is:

1. Stainless spheroidal carbide cast iron material:

comprising of iron (Fe) as its main component, C 0.6~4.0% and V 4~15% as its necessary components, P 0.01~0.15%, S 0.01~0.05%, Al 0.05~1.0% and Mg 0.01~0.2% as gas (hydrogen) bubble assistants, and Si 0.2~4.5%, Cr 13~30%, Mn 0.2.~3.0%, and Ni and/or Co 4~15% as anticorrosion matrix formers in weight %;

produced by the process that minute spheroidal space of gas (hydrogen) bubbles is dispersed substantially equally into molten metal positively by melting at 1673~1973 K which is the bubbling reaction temperature, and spheroidal vanadium carbide of a covalent bond is crystallized inside of the spheroidal space.

2. Stainless spheroidal carbide cast iron material:

comprising of iron (Fe) as its main component, C 0.6~4.0% and V 4~15% as its necessary components, P 0.01~0.15%, S 0.01~0.05%, Al 0.05~1.0%, and Mg 0.01~0.2% as gas (hydrogen) bubble assistants, alloy elements 0.1~15% of one or more kinds of Ca, Ba, Sr and rare-earth metal as a gas (hydrogen) bubble stabilizer, and Si 0.2~4.5%, Cr 13~30%, Mn 0.2~3.0%, and Ni and/or Co 4~15% as anticorrosion matrix formers in weight %;

produced by the process that minute spheroidal space of gas (hydrogen) bubbles is dispersed substantially equally into molten metal positively by high temperature melting at 1673~1973 K which is the bubbling reaction temperature, and spheroidal vanadium carbide of a covalent bond is crystallized inside of the spheroidal space.

3. Stainless spheroidal carbide cast iron material as set forth in claim 1 comprising a mixture of said alloy elements and at least one or more kinds selected from the group consisting of:

(a) Mo 0.05~15%;

(b) Ti 0.01~5%;

(c)B 0.01~2%; and (d) at least two or more kinds of alloy elements of Cu, W, Zr, Co, Nb, Ta and Y 0.2~5%.

4. Stainless spheroidal carbide cast iron material as set forth in claim 2 comprising a mixture of said alloy elements and at least one or more kinds selected from the group consisting of:

(a) Mo 0.05~15%;

(b)Ti 0.01~5%;

(c) B 0.01~2%; and (d) at least two or more kinds of alloy elements of Cu, W, Zr, Co, Nb, Ta and Y 0.2~5%.

5. Stainless spheroidal carbide cast iron material as set forth in claim 1 comprising a mixture of said alloy elements and at least one or more kinds selected from the group consisting of:

(a) Mo 0.05~5%;

(b) Ti 0.01~1.0%;

(c) B 0.01~0.5%; and (d) at least two or more kinds of alloy elements of Cu, W, Zr, Co, Nb, Ta and Y 0.2~10%.

6. Stainless spheroidal carbide cast iron material as set forth in claim 2 comprising a mixture of said alloy elements and at least one or more kinds selected from the group consisting of:

(a) Mo 0.05~5%;

(b)Ti 0.01~1.0%;

(c) B 0.01~0.5%; and (d) at least two or more kinds of alloy elements of Cu, W, Zr, Co, Nb, Ta and Y 0.2~10%.

* * * * *